United States Patent [19]

Hammelmann

[11] Patent Number: 4,923,120

[45] Date of Patent: May 8, 1990

[54] NOZZLE DEVICE

[76] Inventor: Paul Hammelmann, Zum Sundern 17, 4740 Oelde 1, Fed. Rep. of Germany

[21] Appl. No.: 335,943

[22] Filed: Apr. 10, 1989

[30] Foreign Application Priority Data

Apr. 12, 1988 [DE] Fed. Rep. of Germany ..... 38121328

[51] Int. Cl.[5] ..... B05B 3/06

[52] U.S. Cl. ..... 239/252; 239/259; 134/179

[58] Field of Search ..... 134/176, 179; 239/251, 239/252, 259, 261

[56] References Cited

U.S. PATENT DOCUMENTS

| | | | |
|---|---|---|---|
| 1,827,339 | 10/1931 | Steininger | 239/252 |
| 1,857,766 | 5/1932 | Peterson | 239/252 |
| 2,315,844 | 4/1943 | Ferrando et al. | 239/259 |
| 2,983,452 | 5/1961 | Lindbloom | 239/261 |
| 3,386,662 | 6/1968 | Kennedy et al. | 239/261 |
| 3,744,721 | 7/1973 | Baumstark, Jr. | 239/261 |
| 4,439,954 | 4/1984 | Bennett | 239/251 |
| 4,704,826 | 11/1987 | Kirkland | 239/252 |

*Primary Examiner*—Andres Kashnikow

*Assistant Examiner*—Christopher G. Trainor

*Attorney, Agent, or Firm*—Michael J. Striker

[57] ABSTRACT

The nozzle device having a plurality of spray orifices comprises a nozzle support rotatably mounted about a rotation axis and drivable by the reaction force of pressurized water issuing from the orifices, whose rotational motion is braked by an eddy current brake, and a stationary housing having a pressurized water connector. The nozzle device may be used with high operating pressures, particularly in cleaning rust and eroding concrete. A seal against these high operation pressures between the stationary parts and the water-guiding rotation parts in the housing is provided. A stationary sleeve with a central passage in the housing extends from the pressurized water connector guiding pressurized water into the central duct of a hollow shaft connected to the nozzle support rotatably mounted in the housing. The central passage widens in diameter relative to the central duct. Between the sleeve and the bounding surfaces of the widened passage a labyrinth-like sealing gap is provided with a plurality of circular or semicircular grooves located in the sleeve which widen the sealing gap on one side.

16 Claims, 4 Drawing Sheets

NOZZLE DEVICE

BACKGROUND OF THE INVENTION

My invention is related to a nozzle device, especially for a water spraying system.

The known nozzle device comprises a nozzle support having a plurality of spray orifices mounted rotatable about an axis, drivable by the reaction force from pressurized water issuing from the spray orifices, whose rotational motion is braked by a brake device and a stationary housing having a pressurized water connector.

A nozzle device of this kind operates according to the water-wheel principle and is provided with a brake device acting hydraulically, mechanically or by eddy current or magnetic principles to limit its rotary speed.

The seal of the rotating shaft against the stationary housing with increasing operating pressure (100 bar and more) is a problem which is only controllable with difficulty by pairing of materials with good friction coefficients. Since this kind of seal undergoes an elastic deformation under the influence of the operating medium, it presses on itself which stops the rotary motion.

SUMMARY OF THE INVENTION

Accordingly, it is an object of the present invention to provide an improved nozzle device of the above-described kind which can be used in continuous operation for water pressures with high and the highest operating pressures. It is also an object of the present invention to provide a nozzle device of the above-described kind which does not stop or jam in continuous high pressure operation.

In keeping with these objects and with others which will become apparent hereinafter, this nozzle device further comprises a stationary sleeve having an upstream and a downstream end extending from the pressurized water connector conducting pressurized water into a central duct of a hollow shaft connected with the nozzle support rotatable in the housing. The sleeve extends in a central passage of the hollow shaft which is widened in diameter relative to the central duct. A labyrinth-like sealing gap is provided between the sleeve and the bounding surface of the central passage comprising a plurality of grooves located in the sleeve. This gap is widened on one side with these circular grooves.

The pressurized water is fed from the pressurized water connector through the sleeve and the hollow shaft into the nozzle support and to the spray orifices. The reaction force of the pressurized water issuing from the spray orifices rotates the nozzle support because of the suitably inclined orientation of the spray nozzles.

The high pressure of the pressurized water fed to the sleeve is reduced stepwise by the labyrinth-like sealing gap with the grooves positioned on the sleeve periphery, which widen the circular gap between the sleeve and the central passage of the hollow shaft. The tolerances in the vicinity of the labyrinth-like sealing gap are so chosen that a minimum residual throughput of pressurized medium occurs, which acts for cooling and lubrication between the stationary sleeve and the rotating hollow shaft.

The sleeve is a part which wears out and must be replaced from time to time. The replacement of the sleeve can be performed in an easy way. The sleeve is formed as an inserted part and is held in position by a downstream portion of the pressurized water feel screwed in the pressurized water connector.

To increase the useful life of the sleeve, the sleeve is made from a material whose elastic modulus is larger than that of the hollow shaft. A regulating effect under the applied fluid pressure occurs in the sleeve due to the reduction of the gap cross section relative to the hollow shaft. Wear occurring in the sleeve is thus compensated.

Because of the high operating pressure sharp edges or corners in the transition region from the widened central passage of the hollow shaft to the central duct are avoided and this transition region is provided with an S-shaped cross section.

The nozzle device may be operated with operating pressures from between 1.00 and 3.00 bar.

The nozzle device can be used for cleaning rust, paint or lacquer and concrete to a depth of several centimeters.

The nozzle device can be used at operating pressures make a sand stream normally used in sand-blasting surfaces unnecessary.

The hollow shaft rotatably mounted in the stationary housing feeding pressurized water to the spray orifices can be connected with different nozzle supports so that a comparatively larger space remains for different shape tools.

There are a number of possible embodiments of my invention. The upstream end of the sleeve can have a circular flange, which is supported on a sealing ring contacting on a ring-like surface of the housing and the sleeve then can be insertable in the housing and the central passage of the hollow shaft. The larger part of the sleeve is advantageously located in the central passage of the hollow shaft. The elastic modulus of the sleeve should be larger than that of the hollow shaft. The upstream end of the hollow shaft has a water outlet and projects into a receiving cavity of the nozzle support. The hollow shaft can be detachably secured with the nozzle support.

The stationary housing can be cylindrical and can have a bearing interiorly for the hollow shaft, which is equipped with a circular flange supported on another of the bearings in the vicinity of the upstream end of the hollow shaft.

The downstream end of the housing is engaged by a ring, which supports a plurality of permanent magnets, which are enclosed by a copper disk spaced therefrom, which is attached to a brake support attached to the nozzle support. The ring is movable stepwise in the longitudinal direction relative to the housing and is securable.

The nozzle support can be substantially cylindrical or shaped like a rectangular- or trapezoidal cross-sectioned bar.

A brake device which is an eddy current brake can be used. A plurality of permanent magnets can be mounted in the vicinity of the rear end of the nozzle support and a copper disk is provided spaced from the nozzle support, which is attached to the housing. The distance between the permanent magnets and the copper disk may be adjustable.

In one embodiment of the invention the downstream end of the sleeve can have a pressurizable orifice, which is connected in series to a diffusor provided in said hollow shaft.

DETAILED DESCRIPTION OF THE DRAWING FIGURES

Figure 2:
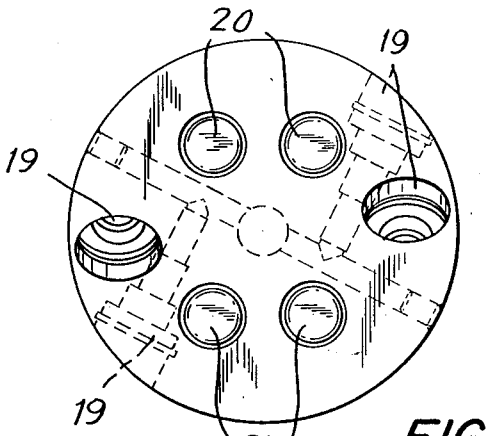
Figure 1:
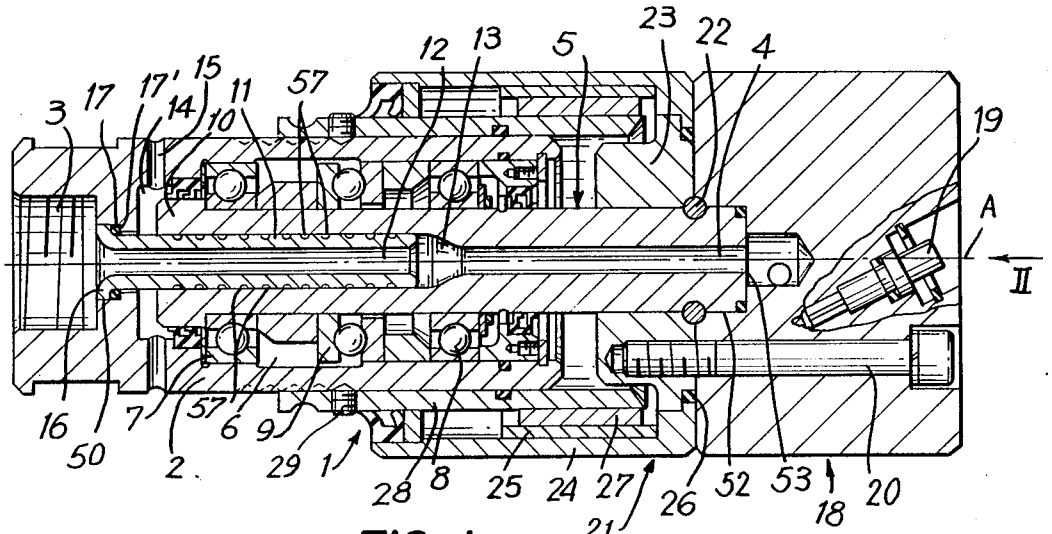
Figure 3:
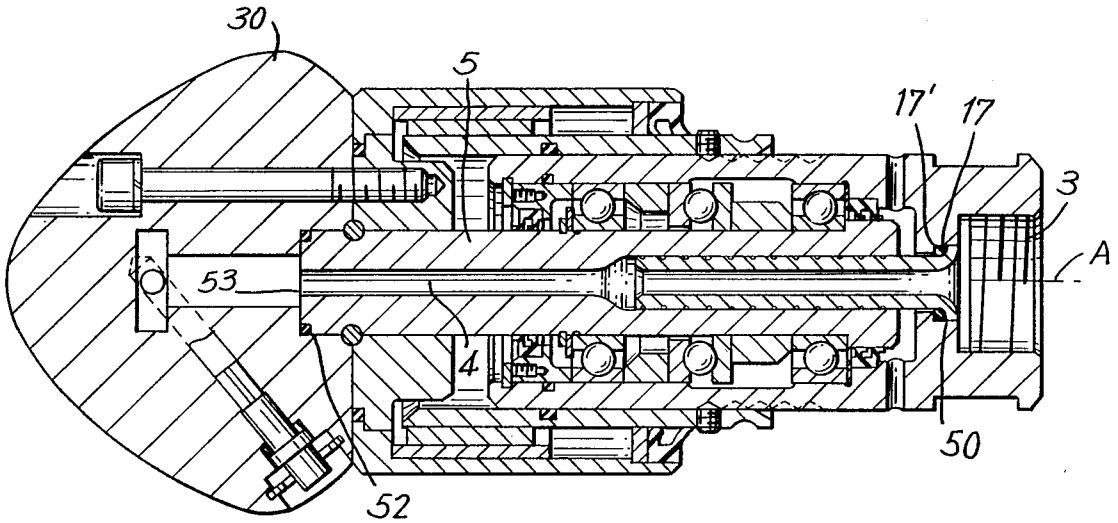
Figure 5:
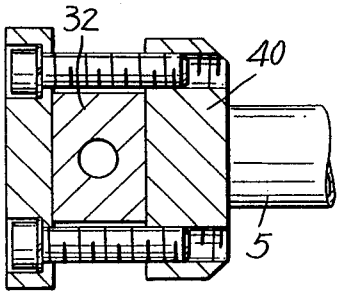
Figure 7:
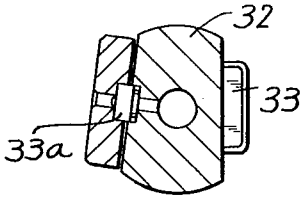
Figure 6:
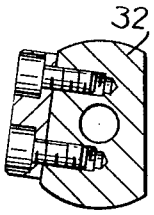
Figure 4:
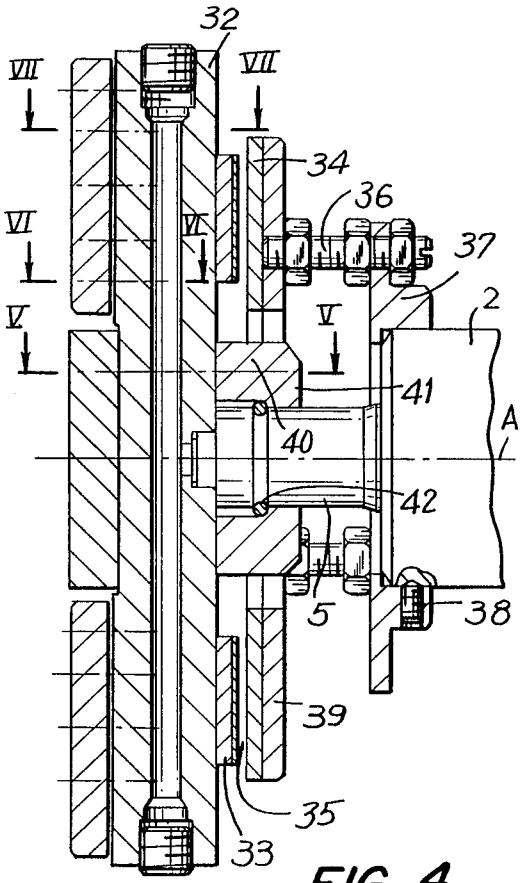
Figure 8:
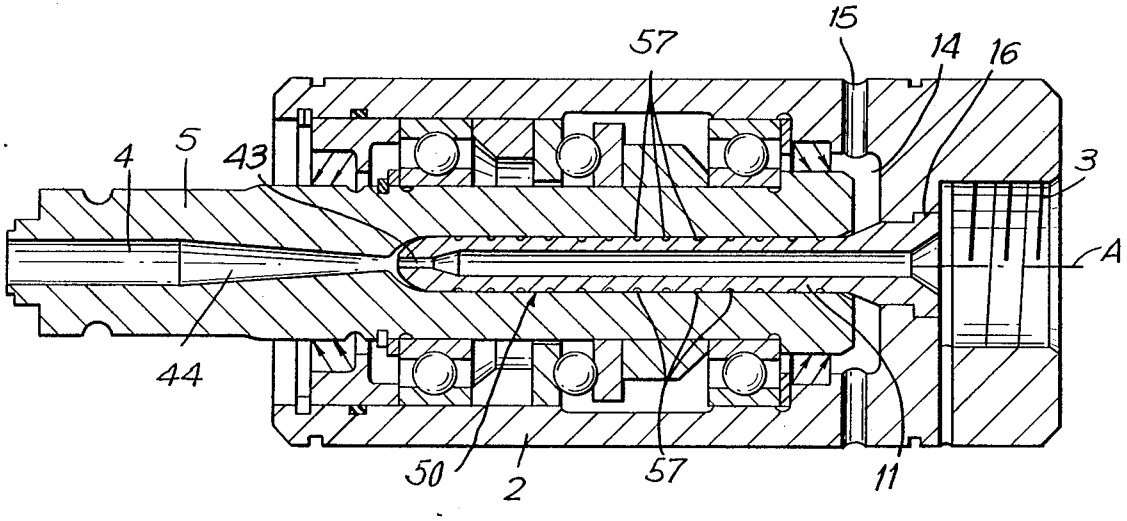

The objects, features and advantages of my invention will be made more apparent from the following detailed description, reference being made to the accompanying drawing in which:

FIG. 1 is a longitudinal cross sectional view of a nozzle device according to my invention, FIG. 2 is a front elevational view as seen in the direction of the arrow II in FIG. 1, FIG. 3 is a longitudinal cross sectional view of another embodiment of a nozzle device according to my invention, FIG. 4 is a cross sectional view of nozzle device, which can be combined with a housing and a hollow shaft rotatably mounted in the housing, FIG. 5 is a cross sectional view of the apparatus of FIG. 4 taken along the section line V—V of FIG. 4, FIG. 6 is a cross sectional view of the apparatus of FIG. 4 taken along the section line VI—VI in FIG. 4, FIG. 7 is a cross sectional view of the apparatus of FIG. 4 taken along the section line VII—VII in FIG. 4, and FIG. 8 is a longitudinal cross sectional view of an additional embodiment of the nozzle device.

DETAILED DESCRIPTION OF THE INVENTION

The nozzle device 1 has a locally cylindrical housing 2, which is equipped with a pressurized water connector 3.

A hollow shaft 5 provided with a central duct 4 is mounted in the housing 2 rotatable about a longitudinal rotation axis A. For this purpose two pressure bearings 7 and 8 and a shoulder bearing 9 are provided in an interior cavity 6 of the housing 2 in this embodiment. A circular flange 10 of the hollow shaft 5 is supported on the pressure bearing 7.

A central passage 12 in the hollow shaft 5 widened relative to the central duct 4 is provided &:o receive a stationary sleeve 11. Its transitional region opening into the central duct 4 has a S-shaped longitudinal cross section so that sharp edges are avoided in this region.

The sleeve 11 has a plurality of semicircular cross-sectioned grooves 57 in its periphery spaced comparatively closely together which are a part of a labyrinth-like sealing gap 50 between the sleeve 11 and the bounding surfaces of the widened central passage 12.

The partial flow of pressurized medium through the labyrinth-like sealing gap 50 is received by a chamber 14, which is equipped with exterior-going radial escape passages 15.

The sleeve 11 has a circular flange 16 on the upstream end adjacent or facing the pressurized water connector 3, which is braced on a sealing ring 17, which contacts on a ring-like surface 17, on the housing, which continues from or connects with passage surfaces of the housing 2 for the sleeve 11.

In the embodiment according to FIGS. 1 and 2 a nozzle support 18, in which the spray orifices 19 are located, comprises a cylindrical piece, which is attached to a brake support 21 by screws 20 and with the hollow shaft 5 by a half ring 22. The spray orifices 19 are fed with pressurized water by a duct system provided in the nozzle support 18, which is supplied with pressurized water from the central duct 4 of the hollow shaft 5.

The brake support 21 comprises a brake end disk 23 and a sleeve-like supporting body 24, to which a copper disk 25 is attached. The supporting body 24 and the brake end disk 23 are attached with each other by a clamping ring 26.

The copper disk 25 encloses a group of permanent magnets 27 which are attached to a ring 28 which surrounds the housing 2 and is secured to the housing by set screws 29. The permanent magnets 27 and the copper disk 25 form an eddy current or magnetic brake, by which the rotary motion of the nozzle support 18 is braked.

The ring 28 is movable and securable stepwise in the longitudinal direction relative to the housing 2. The braking action can be reduced stepwise from the position in FIG. 1 with the braking action.

FIG. 3 shows a different embodiment in contrast to the nozzle device of FIGS. 1 and 2, in which the nozzle support 30 is equipped with orifices 31, which spray laterally and downward.

The nozzle support 32 is shaped like a beam in the embodiment of FIGS. 4 to 7 and equipped with orifices 33*a*. As shown in FIG. 5 and 6 this nozzle support 32 can be trapezoidal or rectangular cross sectioned. The hollow shaft has an end provided with a pressurized water outlet 53 and the end of the hollow shaft projects into a receiving cavity 52 of the nozzle support 30 and is detachably secured with the nozzle support 30.

The permanent magnets 33 are mounted on the rear end of the nozzle support 32 on a circular arc, which corresponds with a copper disk 34.

The distance 35 between the permanent magnets 33 and copper disk 34 is variable. The narrower the gap is, the larger the braking force, which this eddy current brake produces.

The distance 35 is divided by threaded bolts 36, which are secured to a flanged washer 37, which is attached to the housing 2 by set screws 38. The threaded bolts 36 engage with one threaded end in a threaded hole in the supporting disk 39 to which the copper disk 34 is attached.

The nozzle support 32 is secured by screws to a retaining ring 40, which surrounds the hollow shaft 5 and supports itself with an inner flange 41 on a half ring 42 mounted in a circular groove of the hollow shaft 5.

In the embodiment of the nozzle device according to FIG. 8 the sleeve 11 has a pressurized orifice 43 on its front end, which is connected in series with the diffusor 44 provided in the hollow shaft. A partial vacuum at the outlet of the pressurized orifice 43 arises because of fluid entering the diffusor 44 issuing with higher speed from the pressurized orifice, through which fluid is drawn from the circular gap between the sleeve 11 and the hollow sleeve 5. Thus the sealing action of the labyrinth-like sealing gap 50 is substantially improved.

It will be understood that each of the elements described above, or two or more together, may also find a useful application in other types of constructions differing from the types described above.

While the invention has been illustrated and described as embodied in a nozzle device, it is not intended to be limited to the details shown, since various modifications and structural changes may be made without departing in any way from the spirit of the present invention.

Without further analysis, foregoing will so fully reveal the gist of the present invention that others can, by applying current knowledge, readily adapt it for various applications without omitting features that, from the standpoint of the prior art, fairly constitute essential characteristics of the generic or specific aspects of this invention.

What is claimed as new and desired to be protected by Letters Patent is set forth in the appended claims.

I claim:

1. A nozzle device comprising:

a stationary housing with a pressurized water connector having an upstream end and a downstream end;

a nozzle support having a front end and a rear end mounted rotatable about a rotation axis in the vicinity of said stationary housing;

a plurality of spray orifices in said nozzle support, said nozzle support being drivable by reaction force from pressurized water issuing from said spray orifices;

a brake device for the rotational motion of said nozzle support;

a stationary sleeve having an upstream end and a downstream end extending centrally from said pressurized water connector;

a hollow shaft having an upstream end and a downstream end with a central duct and a connected central passage attached to said nozzle support rotatable in said housing, said sleeve extending into said central passage of said hollow shaft, said central passage being widened in diameter relative to said central duct, pressurized water being fed from said said sleeve in said central passage into said central duct of said hollow shaft; and a labyrinth-like sealing gap between said sleeve and a bounding surface of said central passage with a plurality of grooves located in said sleeve, said gap being widened on one side by said grooves.

2. A nozzle device according to claim 1 wherein said grooves are spaced closely together on the periphery of said sleeve and said housing has a chamber for receiving a portion of a pressurized medium flowing through said labyrinth-like sealing gap, which is equipped with at least one escape passage extending radially exteriorly.

3. A nozzle device according to claim 1 wherein said upstream end of said sleeve has a circular flange, which is supported on a sealing ring contacting on a ring-like surface of said housing and said sleeve is insertable in said housing and said central passage of said hollow shaft.

4. A nozzle device according to claim 3 wherein substantial portion of said sleeve is located in said central passage of said hollow shaft.

5. A nozzle device according to claim 1 wherein the elastic modulus of said sleeve is larger than that of said hollow shaft.

6. A nozzle device according to claim 1 wherein said upstream end of said hollow shaft has a water outlet and projects into a receiving cavity of said nozzle support and said hollow shaft is detachably secured with said nozzle support.

7. A nozzle device according to claim 1 wherein said stationary housing is cylindrical and has bearing located interiorly between said housing and said hollow shaft, said hollow shaft having a circular flange supported on one of said bearings in the vicinity of said upstream end of said hollow shaft.

8. A nozzle device according to claim 1 wherein said downstream end of said housing is engaged by a ring, which supports a plurality of permanent magnets, which are enclosed by a copper disk spaced therefrom, which is attached to a brake support attached to said nozzle support.

9. A nozzle device according to claim 8 wherein said ring is movable stepwise in the longitudinal direction relative to said housing and is securable.

10. A nozzle device according to claim 1 wherein said nozzle support is substantially cylindrical.

11. A nozzle device according to claim 1 wherein said nozzle support is shaped like a rectangular-cross sectioned bar.

12. A nozzle device according to claim 1 wherein said nozzle support is shaped like a trapezoidal-cross sectioned bar.

13. A nozzle device according to claim 10 wherein a plurality of permanent magnets are mounted in the vicinity of said rear end of said nozzle support and a copper disk is provided spaced from said nozzle support, and attached to said housing.

14. A nozzle device according to claim 11 wherein the distance between said permanent magnets and said copper disk is adjustable.

15. A nozzle device according to claim 1 wherein said downstream end of said sleeve has a pressurizable orifice, which is connected in series to a diffusor provided in said hollow shaft.

16. In a nozzle device comprising a nozzle support having a plurality of spray orifices mounted rotatable about an axis, drivable by reaction force from pressurized water issuing from said spray orifices, whose rotational motion is braked by a brake device and a stationary housing having a pressurized water connector, the improvement wherein a stationary sleeve extending from said pressurized water connector is provided conducting said pressurized water into a central duct of a hollow shaft also having a connected central passage, said hollow shaft being connected to said nozzle support rotatable in said housing and said sleeve extending into said central passage of said hollow shaft, said central passage being widened in diameter relative to said central duct, and a labyrinth-like sealing gap is provided between said sleeve and a bounding surface of said central passage with a plurality of circular grooves located in said sleeve, said gap being widened on one side by said grooves.

* * * * *